US012760921B2

(12) United States Patent
Mannfeld et al.

(10) Patent No.: US 12,760,921 B2
(45) Date of Patent: Oct. 13, 2026

(54) WIRELESS GATEWAY DEVICE FOR A HEATING, VENTILATION AND AIR-CONDITIONING (HVAC) SYSTEM

(71) Applicant: Carrier Corporation, Palm Beach Gardens, FL (US)

(72) Inventors: David Mannfeld, Indianapolis, IN (US); Gerald Hunt, Indianapolis, IN (US); Ron Kielkowski, Indianapolis, IN (US); Eric Slone, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 373 days.

(21) Appl. No.: 18/496,046

(22) Filed: Oct. 27, 2023

(65) Prior Publication Data

US 2024/0133570 A1 Apr. 25, 2024
US 2024/0230131 A9 Jul. 11, 2024

Related U.S. Application Data

(63) Continuation-in-part of application No. 17/861,639, filed on Jul. 11, 2022, now Pat. No. 12,331,950.

(60) Provisional application No. 63/221,095, filed on Jul. 13, 2021.

(51) Int. Cl.
*F24F 11/50* (2018.01)
*F24F 11/88* (2018.01)

(52) U.S. Cl.
CPC ..... *F24F 11/50* (2018.01); *F24F 11/88* (2018.01)

(58) Field of Classification Search
CPC ..... F24F 11/50
See application file for complete search history.

(56) References Cited

U.S. PATENT DOCUMENTS

| | | | | |
|---|---|---|---|---|
| 4,034,570 | A | 7/1977 | Anderson et al. | |
| 4,526,010 | A | 7/1985 | Sato et al. | |
| 6,956,463 | B2 | 10/2005 | Crenella et al. | |
| 7,244,294 | B2 | 7/2007 | Kates | |
| 7,379,997 | B2 | 5/2008 | Ehlers et al. | |
| 7,775,452 | B2 | 8/2010 | Shah et al. | |
| 10,070,379 | B2 * | 9/2018 | Cholas | H04W 76/10 |

(Continued)

FOREIGN PATENT DOCUMENTS

| | | | | |
|---|---|---|---|---|
| CN | 107078758 | A * | 8/2017 | G01R 31/58 |
| DE | 102006049402 | A1 | 4/2008 | |

(Continued)

*Primary Examiner* — Suresh Suryawanshi
(74) *Attorney, Agent, or Firm* — CANTOR COLBURN LLP

(57) ABSTRACT

Provided are embodiments for a wireless gateway device for a heating, ventilation, and air conditioning (HVAC) system for providing sensor information and sensor communication over relay-controlled power line. The wireless gate device includes an input/output (I/O) interface, a communication unit, and a controller. The controller is communicably coupled with the I/O interface and the communication unit. The controller is configured to receive operational data from at least one of one or more sensors and a thermostat of the HVAC system over the power line. The controller is also configured to control one or more components of the HVAC system based on the operational data associated with the HVAC system. The controller can also transmit the operational data to a remote server.

12 Claims, 5 Drawing Sheets

(56) References Cited

U.S. PATENT DOCUMENTS

| | | | | |
|---|---|---|---|---|
| 10,156,378 | B2 | 12/2018 | Alsaleem | |
| 10,267,532 | B2 | 4/2019 | Kadah et al. | |
| 10,309,672 | B2 | 6/2019 | Filson et al. | |
| 10,533,768 | B2 | 1/2020 | Mowris et al. | |
| 2005/0090915 | A1 | 4/2005 | Geiwitz | |
| 2006/0174102 | A1 | 8/2006 | Smith et al. | |
| 2009/0013703 | A1 | 1/2009 | Werner | |
| 2010/0118983 | A1* | 5/2010 | Weber | H04B 3/548 375/257 |
| 2012/0010833 | A1 | 1/2012 | Alro | |
| 2013/0293155 | A1 | 11/2013 | Campbell et al. | |
| 2018/0048309 | A1 | 2/2018 | Vogt, IV et al. | |
| 2019/0353368 | A1 | 11/2019 | Gillette et al. | |
| 2020/0059081 | A1 | 2/2020 | Freeman et al. | |
| 2020/0256577 | A1* | 8/2020 | Apsangi | G05B 23/0283 |
| 2020/0386434 | A1 | 12/2020 | Blair | |
| 2021/0025615 | A1 | 1/2021 | Heigl | |
| 2021/0095876 | A1 | 4/2021 | Branson et al. | |
| 2021/0199322 | A1* | 7/2021 | Jones | F24F 11/32 |

FOREIGN PATENT DOCUMENTS

| | | | | |
|---|---|---|---|---|
| EP | 3407551 | B1 * | 8/2020 | H04L 69/08 |
| KR | 100751834 | B1 | 8/2007 | |
| KR | 101063532 | B1 | 9/2011 | |
| WO | WO-2019089384 | A1 * | 5/2019 | G16Y 20/10 |
| WO | 2020194658 | A1 | 10/2020 | |

* cited by examiner

WIRELESS GATEWAY DEVICE FOR A HEATING, VENTILATION AND AIR-CONDITIONING (HVAC) SYSTEM

CROSS-REFERENCE TO RELATED APPLICATIONS

This application is a continuation-in-part of U.S. patent application Ser. No. 17/861,639, filed Jul. 11, 2022, which claims the benefit of Provisional Application No. 63/221,095 filed Jul. 13, 2021, the disclosure of which is incorporated herein by reference in its entirety.

BACKGROUND

The present disclosure relates to heating, ventilation, and air condition (HVAC) network communications, and more specifically, to HVAC sensor information and sensor communication over a relay-controlled power line.

HVAC components often need to communicate, for example, to provide control and analysis of the HVAC system. Existing HVAC systems employ separate power lines and communication lines to provide communication and power between the HVAC components. There may be a need to leverage the existing wiring to reduce the complexity of HVAC systems that do not conventionally carry digital information.

SUMMARY

This summary is provided to introduce a selection of concepts, in a simplified format, that are further described in the detailed description of the disclosure. This summary is neither intended to identify key or essential inventive concepts of the disclosure nor is it intended for determining the scope of the disclosure.

According to an embodiment, a wireless gateway device for a heating, ventilation, and air-conditioning (HVAC) system is provided. The wireless gateway device includes an input/output (I/O) interface, a communication unit, and a controller. The controller is communicably coupled with the I/O interface and the communication unit. The controller is configured to receive operational data associated with the HVAC system from at least one of one or more sensors and a thermostat of the HVAC system over a power line. The at least one power converter is disposed on the power line to act as an interface between the at least one of the one or more sensors or the thermostat, and the wireless gateway device. The controller is also configured to control one or more components of the HVAC system based on the received operational data associated with the HVAC system, wherein the one or more components of the HVAC system comprise at least one of an indoor unit and an outdoor unit. Further, the controller is configured to transmit, to a remote server, the received operational data associated with the HVAC system.

In addition to one or more of the features described herein, or as an alternative, further embodiments include configuring the controller to generate one or more user interfaces via a display device to receive one or more user inputs from a user of the HVAC system. Further, the controller is being configured to control the one or more components of the HVAC system based on the received operational data and the received one or more user inputs.

In addition to one or more of the features described herein, or as an alternative, further embodiments include configuring the controller to generate one or more control signals based on the received operational data associated with the HVAC system. Further, the controller is being configured to transmit the one or more control signals to control the one or more components of the HVAC system to the thermostat via the power line.

In addition to one or more of the features described herein, or as an alternative, further embodiments include configuring the controller to receive, from the server, one or more operational characteristics of the HVAC system in response to the transmitted operational data. Further, the controller is being configured to control the one or more components of the HVAC system based on the received one or more operational characteristics of the HVAC system.

In addition to one or more of the features described herein, or as an alternative, further embodiments include the controller being communicably coupled to the at least one power line converter for transmitting the one or more control signals over the power line. Further, the at least one power line converter is configured to convert the one or more control signals into one or more communication messages for transmission onto the power line.

In addition to one or more of the features described herein, or as an alternative, further embodiments include the controller being communicably coupled to the at least one power line converter to receive the operational data via the power line. Further, the at least one power line converter is configured to convert one or more communication messages associated with sensor data that are transmitted over the power line into the operational data.

In addition to one or more of the features described herein, or as an alternative, further embodiments include the controller being configured to establish a serial bus line communication for exchanging information with the at least one power line converter.

In addition to one or more of the features described herein, or as an alternative, further embodiments include the controller being configured to monitor power line signals being transmitted over to a power line for determining at least a run-time of the HVAC system.

According to an embodiment, a method for operation of a wireless gateway device for the HVAC system is provided. The method includes receiving operational data associated with the HVAC system from at least one of one or more sensors and a thermostat of the HVAC system over a power line. The method also includes controlling one or more components of the HVAC system based on the received operational data associated with the HVAC system. The one or more components of the HVAC system comprise at least one of an indoor unit and an outdoor unit. The method further includes transmitting, to a remote server, the received operational data associated with the HVAC system.

In addition to one or more of the features described herein, or as an alternative, further embodiments include generating one or more user interfaces via a display device to receive one or more user inputs from a user of the HVAC system. The method further comprises controlling the one or more components of the HVAC system based on the received operational data and the received one or more user inputs.

In addition to one or more of the features described herein, or as an alternative, further embodiments include generating one or more control signals based on the received operational data associated with the HVAC system and transmitting, the one or more control signals to control the one or more components of the HVAC system to the thermostat via the power line. In addition to one or more of the features described herein, or as an alternative, further embodiments include receiving, from the server, one or more operational characteristics of the HVAC system in response to the transmitted operational data and controlling the one or more components of the HVAC system based on the received one or more operational characteristics of the HVAC system.

Technical effects of embodiments of the present disclosure include enhancing the capability of a less complex equipment to incorporate communication capability for remote monitoring functions.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
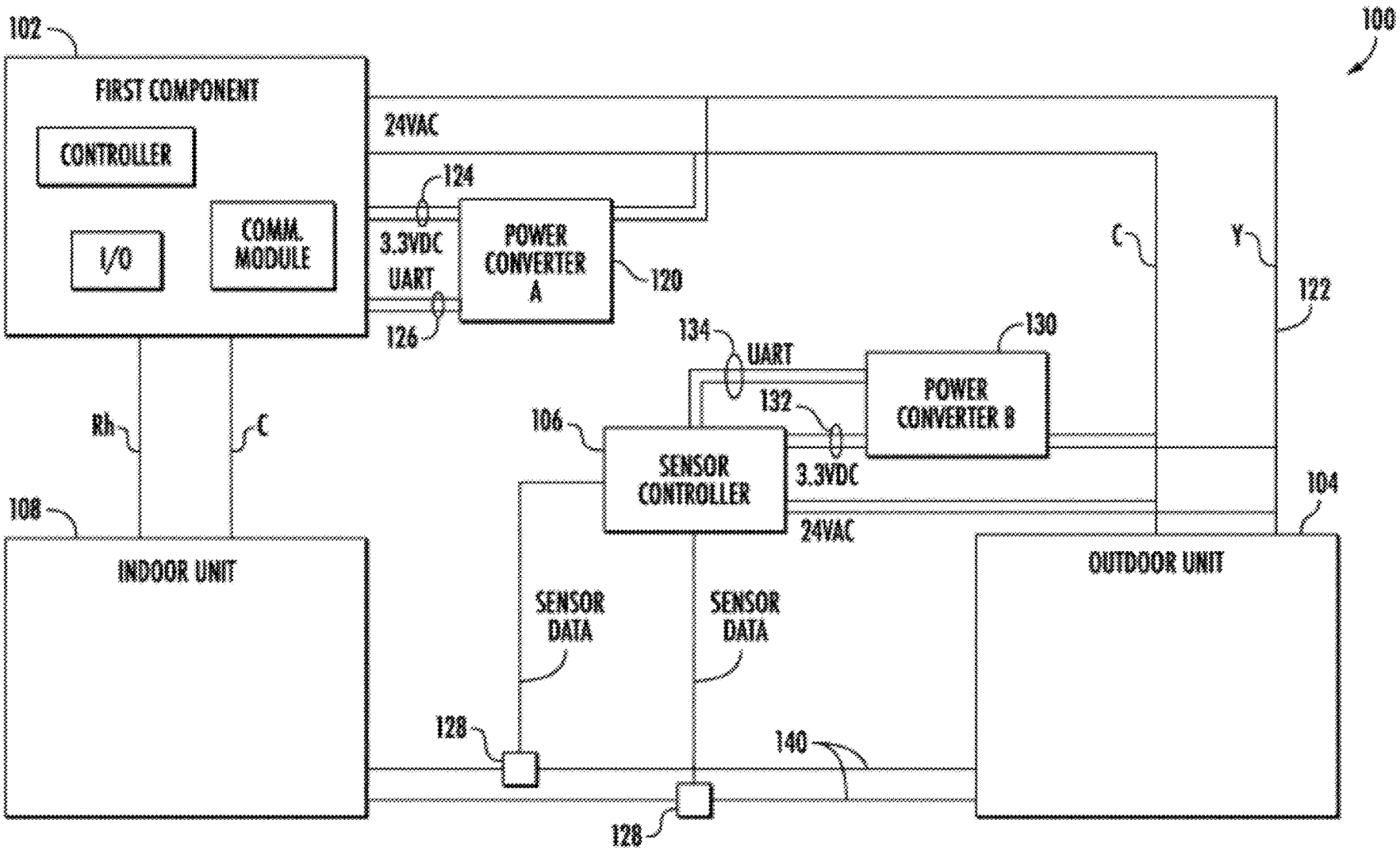
FIG. 1 depicts a schematic block diagram of a system for providing HVAC sensor information and sensor communication over a relay-controlled power line in accordance with one or more embodiments of the disclosure.

FIG. 1 depicts a schematic block diagram of a HVAC system 100 for providing sensor information and sensor communication over relay-controlled power line. FIG. 1 depicts multiple HVAC components in communication over an HVAC network in an example embodiment. A first component 102 includes a controller, a communications module, and an I/O unit. In an example embodiment, the first component 102 is a thermostat of an HVAC system 100 (interchangeably referred as "the system 100"). The controller may include a processor (not shown) and an associated memory (not shown). The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be, but is not limited to, a random access memory (RAM), read only memory (ROM), or other electronic, optical, magnetic or any other computer readable medium. The memory may store executable instructions, that when executed by the processor, cause the controller 102 to perform operations described herein.

The communications module provides enhanced communications between the first component 102 and one or more further components such as a second component 104 (which may be an outdoor unit 104), a third component 106 (which may be a sensor controller 106), and a fourth component 108 (which may be an indoor unit 108), as described herein. In a non-limiting example, the outdoor units can include heat pumps, air conditioning systems, geothermal units, etc. The indoor units can include various equipment for hydronic heat, electric heat, furnace, heat from a heat pump and cooling from a heat pump or air conditioner. Additional functions of the indoor units can include but are not limited to air filtration, air ventilation, humidification, and/or dehumidification. Although FIG. 1 depicts a limited number of components, it should be understood that the communications techniques described herein may apply to any number of components coupled to the HVAC system 100. For example, in some scenarios the outdoor unit may not be required for operation in the system 100. In one or more embodiments of the disclosure, the power line converter A 120 (also referred as "the power converter A 120") is configured to convert data into a communication message that can be transmitted over an AC power line 122 (interchangeably referred as "the power line 122"). In one or more embodiments of the disclosure, the power line converter A 120 must be powered up prior to generating the communication message. The techniques described herein enable the communication message to be transmitted over the power line 122 and is not required to be transmitted over a separate cable/line. The power line converter A 120 can also be configured to detect or "listen" for the communication messages that are transmitted over the AC power line 122 and convert the detected messages into signals that can be processed by the controller of the first component 102.

In one or more embodiments of the disclosure, the power line converter A 120 can be integrated into the first component 102 to enable communication over the power line 122. The power line converter A 120 is powered from the first component 102 over a DC connection 124, and the power line converter A 120 is configured to exchange data with the first component 102 over a serial bus such as the UART 126. For example, the power line converter A 120 is powered by 3.3V DC and communicates over the power line 122. In some embodiments, the power line converter A 120 can be integrated within the first component 102.

In one or more embodiments of the disclosure, power for the outdoor unit (a second component 104) can be received from a separate high-voltage source (not shown). The outdoor unit can include but is not limited to a compressor, condenser, fan, etc. The signal that is received at the outdoor unit from the power line 122 is a low-voltage signal that can be used to close a contactor of the outdoor unit that allows it to be powered on. In some embodiments, components (the sensor controller 106 and a power line converted B 130 (interchangeably referred to as "the power converter B 130") can be arranged on single board (not shown). In such embodiments, the single board is enabled to convert the 24v AC from the power line 122 to 3.3 v DC to provide power to both components, i.e., the sensor controller 106 and the power converted B 130 via a power line 132.

In some embodiments, a third component 106, i.e., the sensor controller, can receive AC power supplied from the first component 102 over the power line 122 for operation. The sensor controller can be coupled to one or more sensors 128 (interchangeably referred to as "the sensors 128"). The sensor controller 106 can provide power to the sensors 128 by converting the AC power from the power line to a form that is compatible with the operation of the sensors 128. In some embodiments, the low-voltage signal from the power line 122 can be used to power the sensor controller (component 106). In other embodiments, the sensors 128 can be powered by a different power source (not shown). As shown in FIG. 1, the sensors 128 can be arranged on the refrigeration lines 140 and are configured to monitor the condition of the refrigeration lines 140. Alternatively, sensors 128 can be used for monitoring compressor power and outdoor temperature.

Responsive to the sensors 128 sensing the refrigeration lines (temperature, pressure, etc.) the sensor data is transmitted to and is obtained by the sensor controller 106. The sensor controller is configured to convert the sensor data and transmit the converted sensor data to the power line converter B 130.

Similar to the power line converter A 120, the power line converter B 130 is configured to convert the received data into a format for transmitting the communication message over the power line 122 to the first component 102, i.e., the thermostat. In a non-limiting example, the sensor controller 106 draws the 24V AC from the power line 122 or from the board (not shown) and converts the power to 3.3V DC to supply power to the power line converter B 130 for operation. Also, the power line converter B 130 communicates with the sensor controller over a serial bus using a UART 134.

In one or more embodiments of the disclosure, the sensor controller 106 can operate in a sleep mode. In the sleep mode, the sensor controller 106 is not processing the sensor data from the one or more sensors 128. In some embodiments, no power can be provided during the sleep mode. In other embodiments, the power can be available in the sleep mode in an intermittent or a continuous fashion. The sensor controller can be switched from the sleep mode and operated in the normal mode. During the normal mode, the sensor controller 106 is obtaining the sensor data from the sensors and processing the sensor data.

In one or more embodiments of the disclosure, the sensors 128 and the sensor controller are powered over the same line that is used for communication of the sensor data. The line power is relay controlled by the thermostat so that the sensors 128 and the sensor controller 106 only sample data and report on the data while the line is activated. The HVAC system can use the Y (outdoor activation) line and the C (Common) line for both power and communications. When the thermostat activates the relay Y on the 24 VAC lines, the sensor controller wakes up, powers power line converter B 130, and starts reading the data from the sensors 128 that are coupled to the sensor controller.

The sensor controller can convert the sensor data from the one or more sensors 128 to a format suitable for the power line converter B 130 and provide the converted data to the power line converter B 130 over the UART 134. The power line converter B 130 is configured to further convert the received data for transmission over the power line 122 and transmit the converted communication message over the power line 122 to the first component 102. The communication message is received by the power line converter A 120 and converts the communication message into a format that can be processed by the controller of the first component 102. Based on the message, the first component 102 controls the other components of the HVAC system and sends power and control signals over power line 122. In some embodiments, the thermostat receives the data from the UART and processes the data. The Y line can be routed through the Indoor Unit then on to the Outdoor Unit.

In one or more embodiments of the disclosure, the first component 102, i.e., the thermostat, can be supplied power from the fourth component 108, i.e., the indoor unit, over the connection Rh. Also, the first component 102 and the fourth component 108 can be coupled over a common connection C. The indoor unit can provide the source of power for the HVAC system 100. In a non-limiting example, the indoor unit can include equipment such as but not limited to an evaporator, blower fan, etc.

In some embodiments, an indoor unit may be included in the system 100 and the outdoor unit may not be included in the system 100. In such embodiments, the sensors 128 can also be used to monitor the indoor unit. In other embodiments, the "Y" line may be used to transmit sensor data about the indoor unit. In such embodiments, 3 power converters may be included in the system 100.

Figure 2:
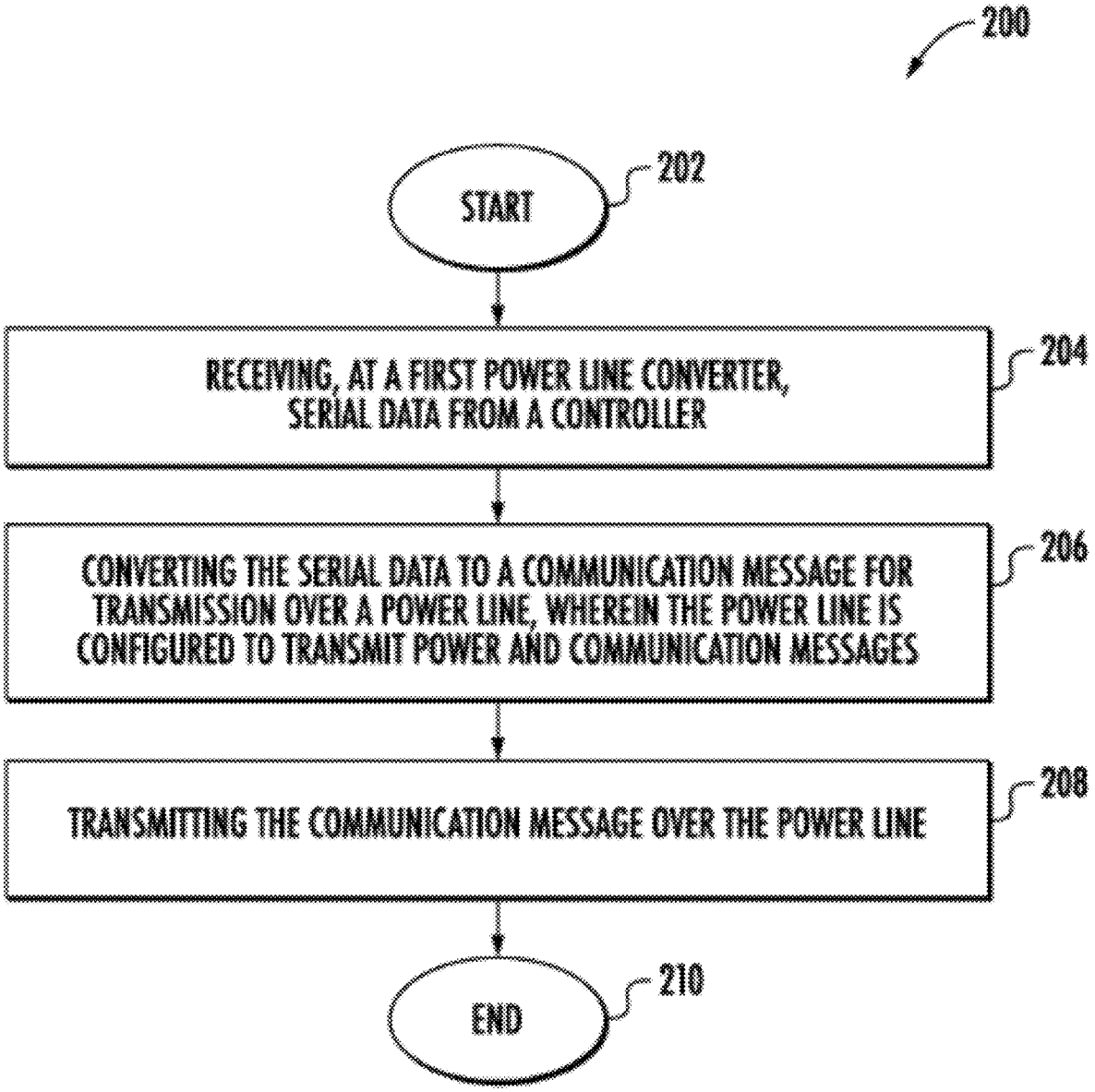
FIG. 2 depicts a flowchart of a method for providing the HVAC sensor information and sensor communication over the relay-controlled power line in accordance with one or more embodiments of the disclosure.

FIG. 2 depicts a flowchart of a method 200 for transmitting a communication message over relay-controlled power line in accordance with one or more embodiments of the disclosure. In one or more embodiments of the disclosure, the method 200 can be performed in an HVAC system such as that shown with reference to FIG. 1. The method 200 begins at block 202 and proceeds to block 204 which provides for receiving serial data from a controller. In one or more embodiments of the disclosure, data such as sensor data or communication data can be received at a sensor controller where the sensor controller converts the data into serial data for processing at a power line converter. The sensor data can include data such as temperature data, pressure data, humidity data, etc. Block 206 converts the serial data to a communication message for transmission over a power line, wherein the power line is configured to transmit power and communication messages. Block 208 transmits the communication message over the power line. The method 200 ends at block 210.

One or more illustrative embodiments of the disclosure are described herein. Such embodiments are merely illustrative of the scope of this disclosure and are not intended to be limiting in any way. Accordingly, variations, modifications, and equivalents of embodiments disclosed herein are also within the scope of this disclosure.

Figure 3:
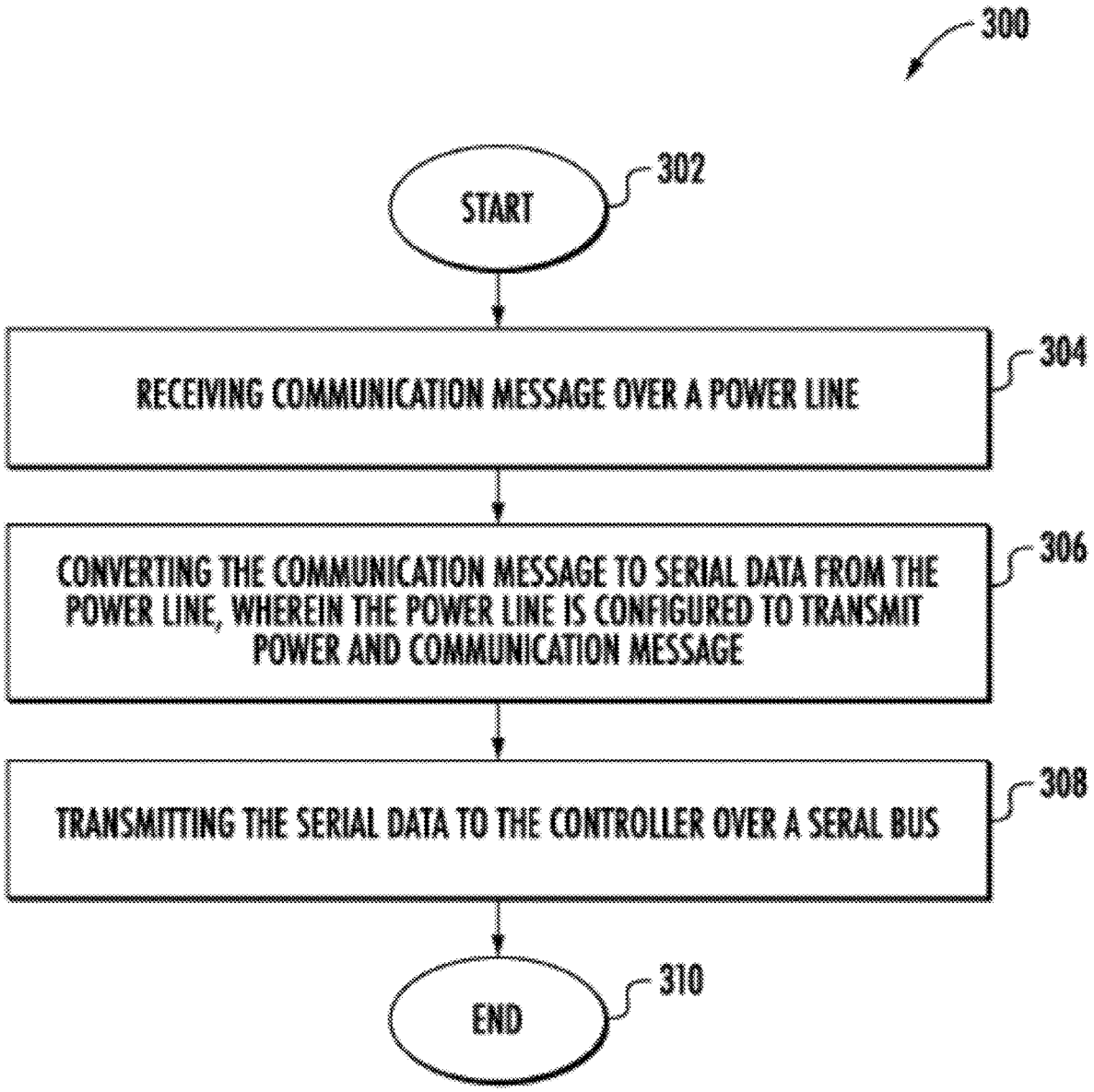
FIG. 3 depicts a flowchart of a method for providing the HVAC sensor information and sensor communication over the relay-controlled power line in accordance with one or more embodiments of the disclosure.

FIG. 3 depicts a flowchart of a method 300 for receiving a communication message over a power line in accordance with one or more embodiments of the disclosure. The method 300 begins at block 302 and proceeds to block 304 which provides for receiving a communication message over a power line. The communication messages correspond to sensor data obtained from one or more sensors coupled to the HVAC system 100. Block 306 converts the communication message to serial data from the power line, wherein the power line is configured to transmit power and communication messages. The communication message can be received at a first power line converter where the communication message is provided from a second power line converter that is coupled to the power line. The first power line converter converts the communication message to serial data which is processed by a processor of the controller. Block 308 transmits the serial data to the controller over a serial bus. The serial data can be transmitted to the controller using a UART. The sensor data from the serial data can be obtained by the controller and used to control the indoor unit and/or outdoor unit according to the sensor data. The method 300 ends a block 310.

Figure 4:
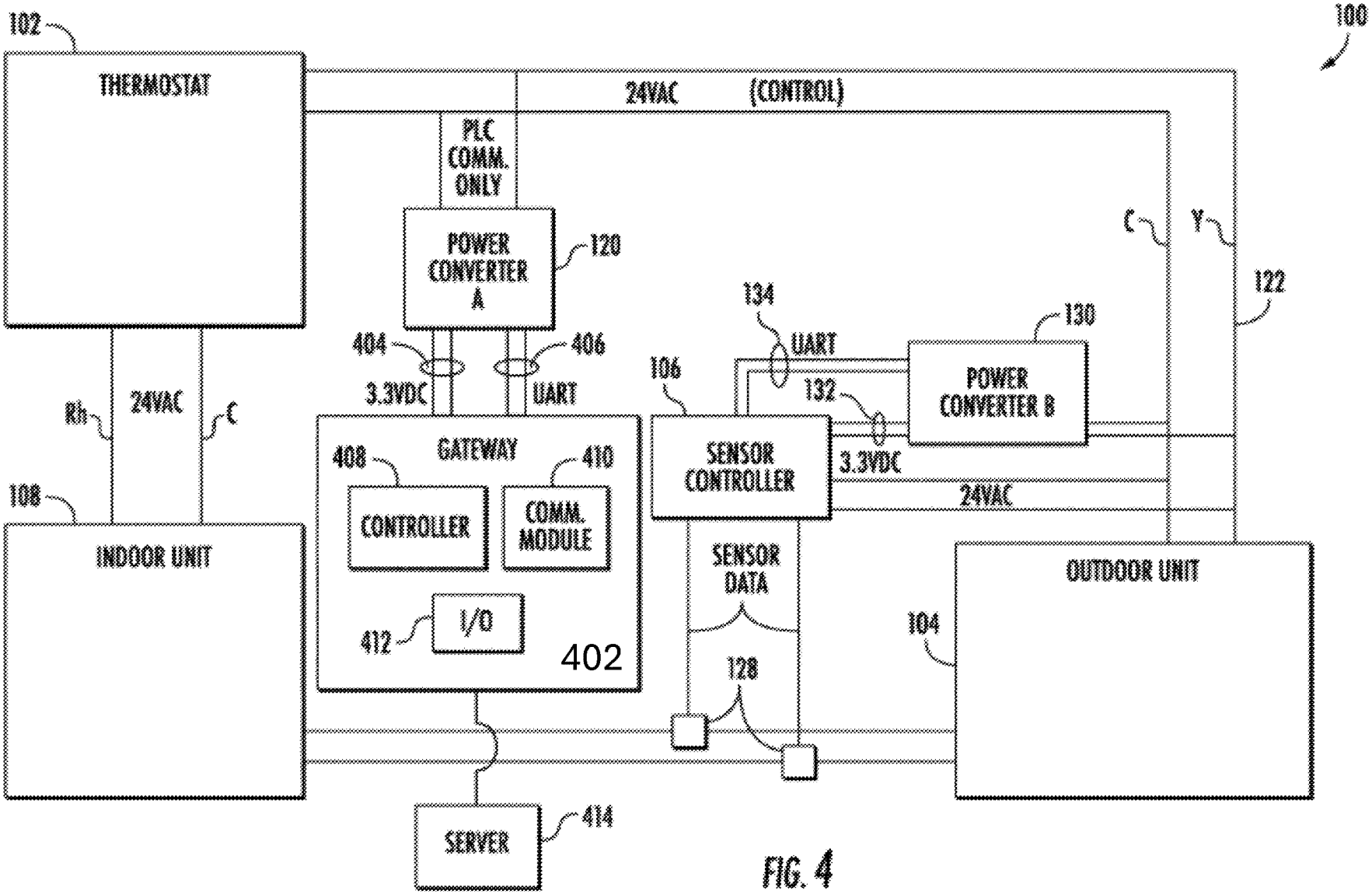
FIG. 4 depicts a schematic block diagram of a system including a wireless gateway device for the HVAC system in accordance with one or more embodiments of the disclosure.

FIG. 4 depicts a schematic block diagram of a system including a wireless gateway device 402 (interchangeably referred to as "the gateway 402") for the HVAC system 100 in accordance with one or more embodiments of the disclosure. The components of FIG. 4 which are similar to components explained in reference to FIG. 1 have been provided with same reference numerals and a corresponding description of such components has been omitted for the sake of brevity.

The wireless getaway device 402 includes a controller 408, an Input/Output (I/O) interface 412 and a communication module 410. The controller 408 may include a processor (not shown) and an associated memory (not shown). The processor may include, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may include, but is not limited to, a random access memory (RAM), read only memory (ROM), or other electronic, optical, magnetic or any other computer readable medium. The memory may store executable instructions, that when executed by the processor, cause the controller 408 to perform operations described herein.

The communications module provides enhanced communications between the wireless gateway device 402 and one or more further components such as the first component 102, the second component 104 (which may be the outdoor unit), the third component 106 (which may be the sensor controller), and the fourth component 108 (which may be the indoor unit), as described herein. Although FIG. 4 depicts a limited number of components, it should be understood that the communications techniques described herein may apply to any number of components coupled to the HVAC system 100. For example, in some scenarios the outdoor unit may not be required for operation in the system.

In some embodiments, the communication module 410 may enable communication between the wireless gateway device 402 and a server 414. The server 414 may be located remotely and communicably connected with the wireless gateway device 402 via a communication network.

The I/O interface 412 may employ communication techniques such as, but not limited to, code-division multiple access (CDMA), high-speed packet access (HSPA+), global system for mobile communications (GSM), long-term evolution (LTE), WiMax, or the like, etc. In some embodiments, the I/O interface 412 may enable user interaction with the wireless gateway device 402 via the input and/or output devices. For example, the input device may be an antenna, microphone, touch screen, touchpad, storage device, transceiver, video device/source, etc. The output devices may be a video display (e.g., cathode ray tube (CRT), liquid crystal display (LCD), light-emitting diode (LED), plasma, Plasma Display Panel (PDP), Organic light-emitting diode display (OLED) or the like), audio speaker, etc.

The wireless gateway device 402 may be disposed in communication with the server 414 via a network interface. In an embodiment, the network interface may be the I/O interface 412. The network interface may connect to the communication network to enable connection of the wireless gateway device 402 with the outside environment and/or device/system. The network interface may employ connection protocols including, without limitation, direct connect, Ethernet (e.g., twisted pair 10/100/1000 Base T), transmission control protocol/internet protocol (TCP/IP), token ring, IEEE 802.11a/b/g/n/x, etc. The communication network may include, without limitation, a direct interconnection, local area network (LAN), wide area network (WAN), wireless network (e.g., using Wireless Application Protocol), the Internet, etc.

In an exemplary embodiment, the controller 408 may be configured to receive operational data from the one or more sensors 128 and the thermostat 102 of the HVAC system 100 over the power line 122. The sensor controller 106 is configured to convert the sensor data from the one or more sensors 128 to a format suitable for the power line converter B 130 and provide the converted data to the power line converter B 130 over the UART 134. The power line converter B 130 is configured to further convert the received data for transmission over the power line 122 and transmit the converted communication message over the power line 122 to the wireless gateway device 402 via the power converter A 120. The operational data is received by the power line converter A 120 and converts the operational data into a format that can be processed by the controller 408. Based on the operational data the wireless gateway device 402 to control the other components of the HVAC system 100 and send power and control signals over power line 122. In some embodiments, the wireless gateway device 402 receives the data from the UART 406 and processes the data. The Y line can be routed through the indoor unit then on to the outdoor unit. In one embodiment, the power line convert A 120 is configured to convert the 24V power supply on the power line 122 to 3.3 v DC to supply power to the wireless gateway device 402 via a DC power line 404.

In some embodiment, the wireless gateway device 402 receives operational data from the thermostat 102 via the power convert A 120 over the power line 122.

The controller 408 is configured to process the received operational data to control one or more components of the HVAC system 100. In some embodiments, the controller of the wireless gateway device 402 is configured to generate one or more user interfaces via a display device to enable a user interaction with the HVAC system 100. The controller 408 may be configured to receive one or more user input via the generated one or more user interfaces to control the one or more components of the HVAC system 100.

The controller 408 may also be configured to generate one or more control signals to control the components of the HVAC system 100 based on the received operational data. The controller 408 is configured to transmit the generated control signals to the thermostat 102 to control the components of the HVAC system 100.

Figure 5:
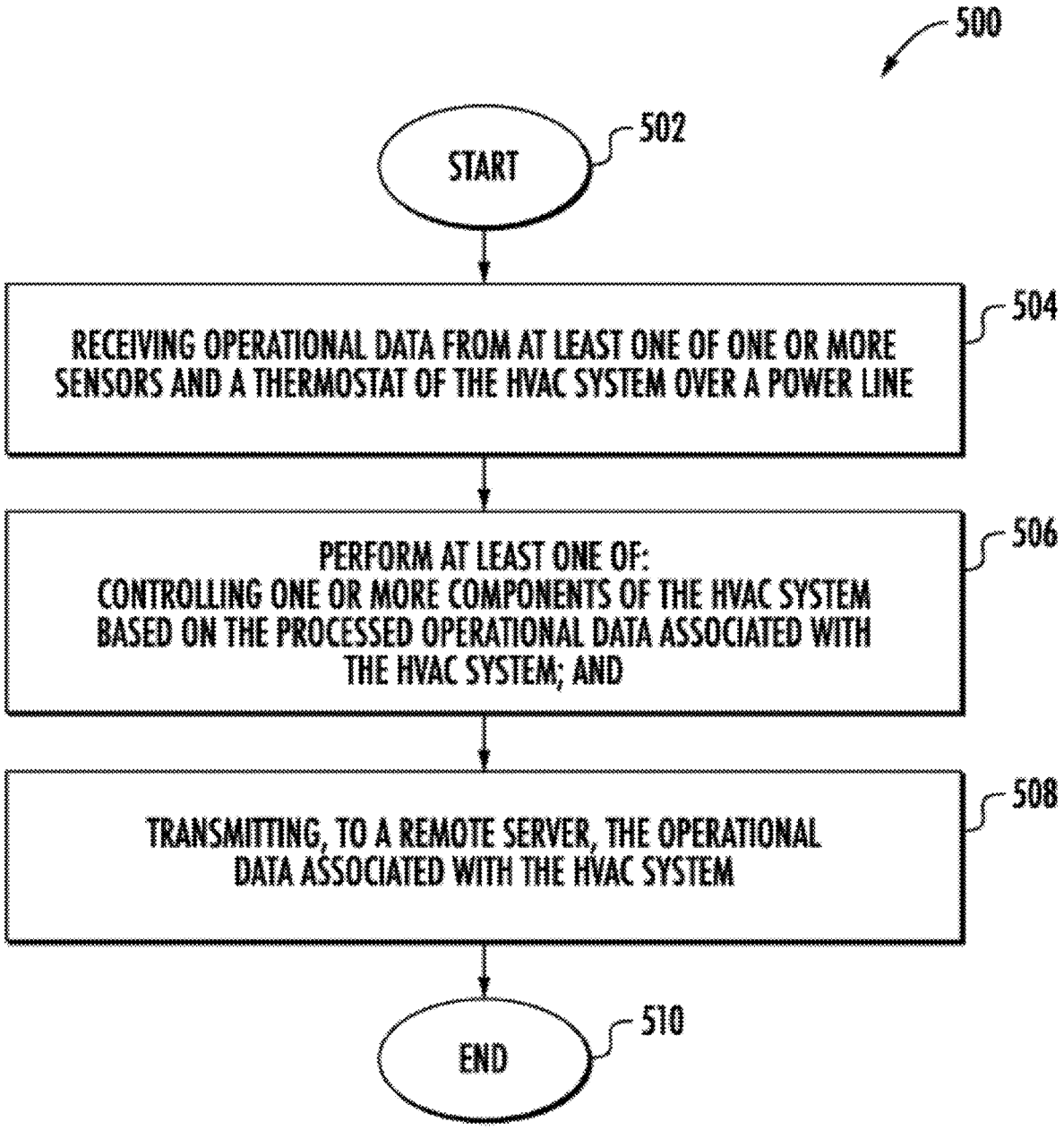
FIG. 5 depicts a flowchart of operating the wireless gate device in accordance with one or more embodiments of the disclosure.

FIG. 5 depicts a flowchart of a method 500 for operation of the wireless gateway device for the HVAC system 100 in accordance with one or more embodiments of the disclosure. The method 500 begins at block 502 and proceeds to block 504 which provides for receiving operational data associated with the HVAC system from at least one of one or more sensors and a thermostat of the HVAC system over a power line. Block 506 performs controlling of one or more components of the HVAC system based on the operational data associated with the HVAC system. Block 508 transmits the operational data associated with the HVAC system to the remote server. The method 500 ends at block 510. The method 500 also includes generating one or more user interfaces via a display device to receive one or more user inputs from a user of the HVAC system and controlling the one or more components of the HVAC system based on the received operational data and the received one or more user inputs. Moreover, the method 500 includes generating one or more control signals based on the received operational data associated with the HVAC system and transmitting, to the thermostat via the power line, the one or more control signals to control the one or more components of the HVAC system. Furthermore, the method 500 includes receiving, from the server, one or more operational characteristics of the HVAC system in response to the transmitted operational data and controlling the one or more components of the HVAC system based on the received one or more operational characteristics of the HVAC system.

One or more illustrative embodiments of the disclosure are described herein. Such embodiments are merely illustrative of the scope of this disclosure and are not intended to be limiting in any way. Accordingly, variations, modifications, and equivalents of embodiments disclosed herein are also within the scope of this disclosure.

The technical benefits and effects include enabling less complex equipment that does not include means for wired communication to exchange communication messages over the power line. The techniques described herein leverage the existing power lines for transmission of both communication information and power with limited modification, thus giving the capability of remote monitoring to the less complex systems.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made, and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure is not limited to the particular embodiment disclosed as the best mode contemplated for carrying out this present disclosure, but that the present disclosure will include all embodiments falling within the scope of the claims.

What is claimed is:

1. A wireless gateway device for a Heating, Ventilation and Air-Conditioning (HVAC) system, comprising:

an Input/Output (I/O) interface;

a communication unit; and a controller communicably coupled with the I/O interface and the communication unit, the controller being configured to:

receive, via at least one power converter, operational data associated with the HVAC system from at least one of one or more sensors or a thermostat of the HVAC system over a power line, wherein the at least one power converter is disposed on the power line to act as an interface between the at least one of the one or more sensors or the thermostat, and the wireless gateway device; and perform:

control one or more components of the HVAC system based on the received operational data associated with the HVAC system, wherein the one or more components of the HVAC system comprise at least one of an indoor unit and an outdoor unit; and transmit, to a remote server, the received operational data associated with the HVAC system.

2. The wireless gateway device of claim 1, wherein the controller is further configured to:

generate one or more user interfaces via a display device to receive one or more user inputs from a user of the HVAC system, and control the one or more components of the HVAC system based on the received operational data and the received one or more user inputs.

3. The wireless gateway device of claim 1, wherein the controller is further configured to:

generate one or more control signals based on the received operational data associated with the HVAC system; and transmit, to the thermostat via the power line, the one or more control signals to control the one or more components of the HVAC system.

4. The wireless gateway device of claim 1, wherein the controller is further configured to:

receive, from the server, one or more operational characteristics of the HVAC system in response to the transmitted operational data; and control the one or more components of the HVAC system based on the received one or more operational characteristics of the HVAC system.

5. The wireless gateway device of claim 1, wherein the controller is communicably coupled to the at least one power line converter for transmitting the one or more control signals over the power line, and wherein the at least one power line converter is configured to convert the one or more control signals into one or more communication messages for transmission onto the power line.

6. The wireless gateway device of claim 1, wherein the controller is communicably coupled to the at least one power line converter o receive the operational data via the power line, wherein the at least one power line converter is configured to convert one or more communication messages associated with sensor data that are transmitted over the power line into the operational data.

7. The wireless gateway device of claim 5, wherein the controller is configured to establish a serial bus line communication for exchanging information with the at least one power line converter.

8. The wireless gateway device of claim 1, wherein the controller is configured to monitor power line signals being transmitted over to the power line for determining at least a run-time of the HVAC system.

9. A method for operation of a wireless gateway device for a Heating, Ventilation and Air-Conditioning (HVAC) system, the method comprising:

receiving operational data associated with the HVAC system from at least one of one or more sensors and a thermostat of the HVAC system over a power line, wherein the at least one power converter is disposed on the power line to act as an interface between the at least one of the one or more sensors or the thermostat, and the wireless gateway device; and performing:

controlling one or more components of the HVAC system based on the received operational data associated with the HVAC system, wherein the one or more components of the HVAC system comprise at least one of an indoor unit and an outdoor unit; and transmitting, to a remote server, the received operational data associated with the HVAC system.

10. The method of claim 9, further comprising:

generating one or more user interfaces via a display device to receive one or more user inputs from a user of the HVAC system, and controlling the one or more components of the HVAC system based on the received operational data and the received one or more user inputs.

11. The method of claim 9, further comprising:

generating one or more control signals based on the received operational data associated with the HVAC system; and transmitting, to the thermostat via the power line, the one or more control signals to control the one or more components of the HVAC system.

12. The method of claim 9, further comprising:

receiving, from the server, one or more operational characteristics of the HVAC system in response to the transmitted operational data; and controlling the one or more components of the HVAC system based on the received one or more operational characteristics of the HVAC system.

* * * * *